US010906329B2

(12) United States Patent
Tsai et al.

(10) Patent No.: US 10,906,329 B2
(45) Date of Patent: Feb. 2, 2021

(54) METHOD FOR PRINTING TRANSPARENT INK ON DIFFERENT PRINTING MEDIA

(71) Applicant: GREAT COMPUTER CORP., New Taipei (TW)

(72) Inventors: Chen-Chien Tsai, New Taipei (TW); Chia-Shou Lai, New Taipei (TW); Chih-Hua Yen, New Taipei (TW)

(73) Assignee: GREAT COMPUTER CORPORATION, New Taipei (TW)

( * ) Notice: Subject to any disclaimer, the term of this patent is extended or adjusted under 35 U.S.C. 154(b) by 162 days.

(21) Appl. No.: 15/869,544

(22) Filed: Jan. 12, 2018

(65) Prior Publication Data

US 2019/0217646 A1 Jul. 18, 2019

(51) Int. Cl.

| | |
|---|---|
| ***B41J 11/00*** | (2006.01) |
| ***B41M 5/00*** | (2006.01) |
| ***B41J 2/21*** | (2006.01) |
| ***B41J 3/407*** | (2006.01) |
| ***B41M 7/00*** | (2006.01) |

(52) U.S. Cl.

CPC ..... *B41J 11/002* (2013.01); *B41J 2/2114* (2013.01); *B41J 3/407* (2013.01); *B41M 5/0029* (2013.01); *B41M 5/0047* (2013.01); *B41M 7/0081* (2013.01)

(58) Field of Classification Search

CPC ..... B41J 11/002; B41J 2/2114; B41J 3/407; B41M 5/0047; B41M 7/0081; B41M 5/0029; G06K 15/105

See application file for complete search history.

(56) References Cited

U.S. PATENT DOCUMENTS

| | | | | |
|---|---|---|---|---|
| 2008/0192100 | A1* | 8/2008 | Nakajima | B41J 2/2107 347/102 |
| 2011/0019236 | A1* | 1/2011 | Hotta | B41J 2/2132 358/3.06 |
| 2014/0017452 | A1* | 1/2014 | Pervan | E04F 15/042 428/172 |
| 2018/0056592 | A1* | 3/2018 | Kouno | G05B 19/4099 |

* cited by examiner

*Primary Examiner* — Justin Seo

(74) *Attorney, Agent, or Firm* — Muncy, Geissler, Olds & Lowe, P.C.

(57) ABSTRACT

A method for printing transparent ink on different printing media is provided. In a one-time printing process, printing with the transparent ink is performed for a plurality of times on a printed product, and a curing process by means of UV light irradiation is then performed once. The method is characterized in that, after performing the printing with the transparent ink for the first time, the curing process by means of UV light irradiation is performed once.

1 Claim, No Drawings

METHOD FOR PRINTING TRANSPARENT INK ON DIFFERENT PRINTING MEDIA

BACKGROUND OF THE INVENTION

Field of the Invention

The present invention relates to a method capable of effectively reducing an effect of a surface tension difference that a coloring or film protecting material has on a lamination process of transparent ink, so as to enhance printing effectiveness of the transparent ink on different printing media.

Description of the Related Art

UV ink, featuring a stackable thickness in overprinting, is frequently applied in special applications similar to 3D printing, such as embossing or the Braille. To present rich color level changes on a printed product, a UV inkjet printer performs a multi-pass printing process according to a file size and a resolution of an image to be printed when performing color separation by color separation software. Thus, an inkjet head prints the data to be printed in several different rounds on a printing object by repeated inkjet overprinting and color stacking, such that ink spots printed by the different rounds of the printing process are accumulated to present a multi-stage printing effect.

Meanwhile, in printing, lamination using transparent ink on printed materials provides texture enhancement, and also significantly increases profits of such printed products. Lamination materials current used for printed materials include toner, ink, gold/silver foils, PU films and traditional ink. It should be noted that, there are differences in surface tensions of the above materials of different manufacturer brands, and surface tensions of materials suitable for printing with transparent ink of different manufacturer brands also vary. When the two are incompatible, the transparent ink may not be easily dispersed evenly and ink gathering or spreading may be caused, resulting in a defect of uneven surfaces of printed products. Therefore, in a current approach, a printing test is first conducted before an actual printing process is performed in order to learn the compatibility between the ink and a medium material on a printed product.

SUMMARY OF THE INVENTION

However, with the above approach, an optimal balance can only be obtained after repeated printing tests. Therefore, the Applicant provides a solution capable of alleviating the above issues generated by surface tensions in one printing process.

The main object of the present invention is to provide a method capable of reducing an effect that a surface tension difference of a coloring or film protecting material has on a lamination process of transparent ink, so as to enhance printing effectiveness of the transparent ink on different printing media.

To achieve the above object, the present invention provides a method for printing transparent ink on different printing media. According to the method, in a one-time printing process, after printing with the transparent ink is performed for a plurality of times on a printed product, a curing process by means of UV light irradiation is performed once. The method is characterized in that, after performing printing with the transparent ink for the first time, the curing process by means of UV light irradiation is performed once.

In implementation, after the printing with the transparent ink is performed for the $2^{nd}$ to the $N^{th}$ times, the final curing process by means of UV light irradiation is performed.

In implementation, after the printing with the transparent ink is performed each time, the curing process by means of UV light irradiation is performed once.

The above and other aspects of the invention will be better understood with regard to the following detailed description of the preferred but non-limiting embodiments. The following description is made with reference to the accompanying drawings.

BRIEF DESCRIPTION OF THE DRAWINGS

There are no drawings attached in this application.

DETAILED DESCRIPTION OF THE INVENTION

A method for printing transparent ink on different printing media according to a preferred embodiment of the present invention is described below.

In the method for, printing transparent ink on different printing media, in a one-time printing process, after performing printing with the transparent ink for a plurality of times on a printed product, a curing process by means of UV light irradiation is performed once.

When performing the printing with the transparent ink for the first time, after a base process is completed, a UV light is turned on to perform a curing process by means of UV light irradiation once on the transparent ink having undergone the base process. As such, the transparent ink having undergone the base process is irradiated and immediately cured, so as to prevent deformation of the transparent ink. After performing the printing with the transparent ink for the $2^{nd}$ to the $N^{th}$ times, a final curing process by means of UV light irradiation is then performed. It should be noted that, the curing process by means of UV light irradiation may also be performed once after the printing with the transparent ink each time, in a way that the transparent ink of the previous time has already cured before the lamination of the transparent ink is stacked each time on the transparent ink of the previous time.

With the above design, the curing process by means of UV light irradiation is activated after the printing of the transparent ink is performed for the first time or even after the printing of the transparent ink is performed each time. Thus, even after several times of printing and stacking, the transparent ink does not incur the issue of gathering or spreading due to the surface tension, so as to provide printing quality that is significantly different from that of the prior art.

In conclusion, based on the disclosure of the application, the method for printing transparent ink on different printing media provided by the present invention indeed meet its anticipated object, and is industrially applicable.

While the invention has been described by way of example and in terms of the preferred embodiment, it is to be understood that the invention is not limited thereto. On the contrary, it is intended to cover various modifications and similar arrangements and procedures derived based on the disclosure or teaching of the application, and the scope of the appended claims therefore should be accorded the broadest interpretation so as to encompass all such modifications and similar arrangements and procedures.

What is claimed is:

1. A method for printing transparent ink on different printing media, the method comprising:

in a one-time printing process, printing a same printing position of a printed product being performed a plurality of times; and performing a curing process by means of UV light irradiation after said one-time printing process is completed, wherein the curing process by means of UV light irradiation is merely performed after a printing of the transparent ink is performed for the first time and the final time of the plurality of times of printing.

* * * * *